US005488382A

United States Patent [19]

Fenzi et al.

[11] Patent Number: 5,488,382

[45] Date of Patent: Jan. 30, 1996

[54] LOW NOISE AMPLIFIER

[75] Inventors: Neal O. Fenzi; Stephen I. Long, both of Santa Barbara, Calif.

[73] Assignee: Superconductor Technolgies Inc., Santa Barbara, Calif.

[21] Appl. No.: 438,522

[22] Filed: May 10, 1995

Related U.S. Application Data

[63] Continuation of Ser. No. 37,598, Mar. 26, 1993, abandoned.

[51] Int. Cl.[6] ..... H01Q 1/26

[52] U.S. Cl. ..... 343/700 R; 343/701

[58] Field of Search ..... 343/700 R, 701, 343/745, 741, 742, 744; H01Q 1/26

[56] References Cited

U.S. PATENT DOCUMENTS

| | | | |
|---|---|---|---|
| 3,827,053 | 7/1974 | Willie et al. | 343/701 |
| 4,459,595 | 7/1984 | Kramer et al. | 343/701 |
| 4,897,662 | 1/1990 | Lee et al. | 343/701 |
| 5,171,733 | 12/1992 | Hu | 250/336.2 |

OTHER PUBLICATIONS

Walker et al, "Superconducting Superdirectional Antenna Arrays", IEEE Transactions on Antennas and Propagation vol. AP-25, No. 6, Nov. 1977, pp. 885-887.

*Primary Examiner*—Donald T. Hajec
*Assistant Examiner*—Hoanganh Le
*Attorney, Agent, or Firm*—Lyon & Lyon

[57] ABSTRACT

A detector for electromagnetic radiation includes a high Q, low loss antenna and a low noise amplifier requiring a high input impedance. In the preferred embodiment, the antenna comprises a low resistance, superconductive coil. The antenna forms a resonant circuit with a low loss capacitor, optionally a capacitor including superconductors. The output of the resonant circuit is provided as input to the semiconductor amplifier. In the preferred embodiment, junction FETs, preferably arranged in a cascode pair, are included in the semiconductor amplifier. In one aspect of the invention, feedback is provided from the output of the amplifier to its input. Effective loading of the antenna results, lowering the Q of the antenna, and broadening the bandwidth of the detector. Optimum matching of the antenna to the noise factor of the amplifier is achieved.

14 Claims, 2 Drawing Sheets

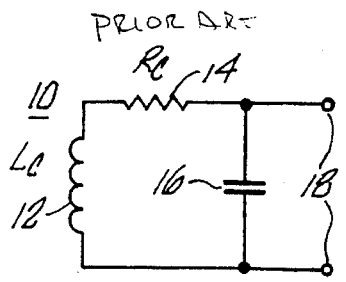
FIG. 1
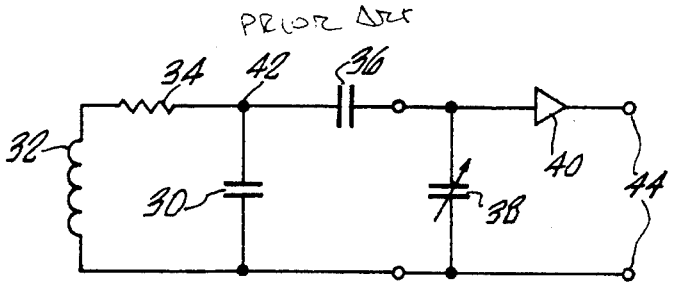
FIG. 3
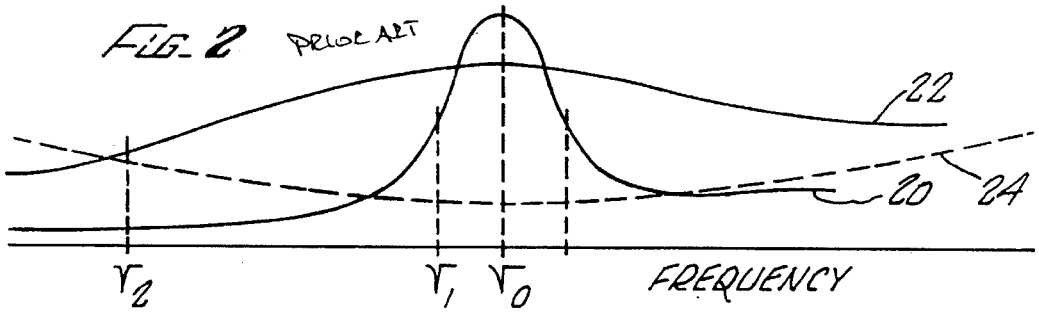
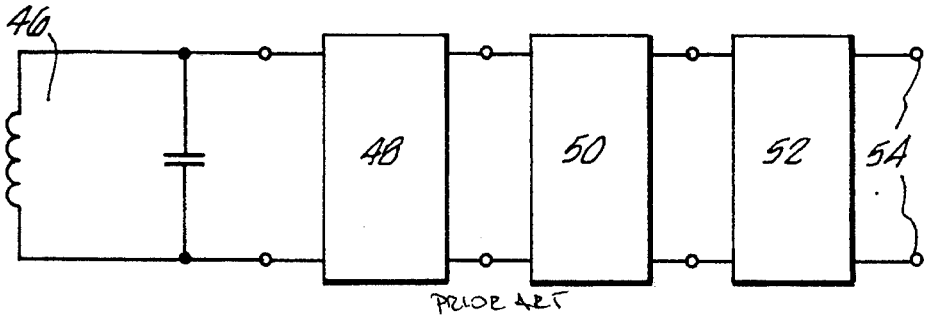
FIG. 4
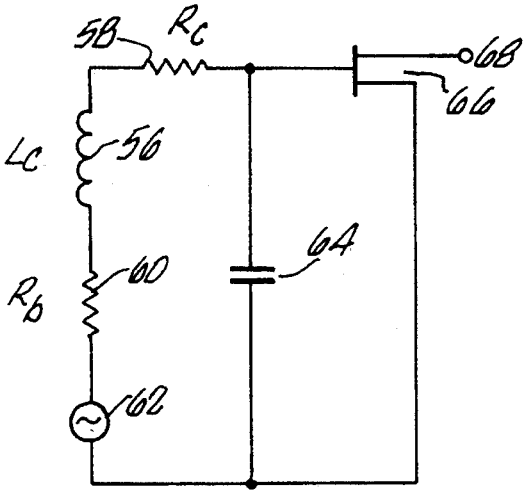
FIG. 5
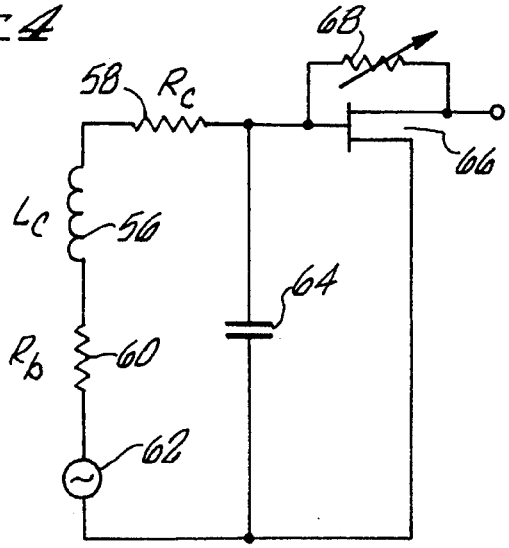
FIG. 6

LOW NOISE AMPLIFIER

This is a continuation of application Ser. No. 08/037,598, filed on Mar. 26, 1993 and which designated the U.S. now abandoned.

DESCRIPTION

1. Field of the Invention

The invention relates to antenna arrangements for detecting electromagnetic signals, and low noise amplifiers for use with such antenna. More particularly, the invention relates to low noise amplifiers adapted for use with low resistance antennas, especially superconducting antennas.

2. Background of the Invention

The use of antenna to detect electromagnetic signals ("signals") has long been known. Antenna have been formed in many shapes and sizes, and composed of various materials. For simplicity, an antenna comprising a conductive loop will be considered. As a signal passes through a loop, currents are induced in the loop, resulting in detectable signals. Often, the antenna is a resonant circuit, that is, a circuit which is responsive to excitation by signals at a given frequency or range of frequencies.

FIG. 1 shows a simplified version of the electrical components in a resonant detection circuit 10. The loop may be represented by the series combination of the inductor 12, labelled $L_c$ for coil inductance, and resistor 14, labelled $R_c$ for coil resistance. Capacitor 16 is placed across the coil, thereby completing the resonant circuit 10. The voltage may be measured at the output connections 18.

Conventionally, detection coils are made of metal, preferably copper. While such metals have generally low resistance relative to conventional materials, their resistance is not negligible. The resulting resonant circuit 10 has a frequency response which varies as shown in FIG. 2. At the resonant frequency ($v_o$) the signal is strongest. As the frequency moves away from the resonant frequency, the signal intensity decreases.

The "Q" of a resonant circuit is a measure of the lossiness of the circuit. A high Q resonant circuit will have a response 20 which is relatively sharper or spikier than a response 22 for a lower Q circuit. The bandwidth of the circuit is the range over which signals can be detected. A relatively high Q response 20 has a narrower bandwidth than the low Q response 22. By way of example, when the signal intensity in FIG. 2 has dropped by half from the maximum, the difference between $v_o$ and $v_1$ is less than the difference between $v_o$ and $v_2$. The lossier the materials used in the antenna, the lower the Q, and the larger the bandwidth. A resonate detection circuit consists of a resonate antenna and a low noise amplifier.

Another component relevant to the resonant detection circuit is the noise factor bandwidth. The noise factor is defined to be the ratio of the signal to noise ratio at the input to the signal to noise ratio at the output. The noise factor is shown as dashed line 24 for the relatively high Q response 20. The noise factor is a function of the impedance presented to the amplifier. The impedance of a resonant network changes quickly with frequency. This change in impedance causes the noise factor of a low noise amplifier to change rapidly with frequency.

FIG. 3 shows a particular resonant circuit antenna and amplifier used in the prior art. This particular arrangement is conventionally used to detect signals in magnetic resonance imaging systems. An inductor 32 and series connected resistance 34 are typically formed from a copper coil. A resonant capacitor 30 completes the resonant circuit with the inductor 32 and resistance 34. An isolation capacitor 36 is connected to node 42. A variable capacitor 38 permits turning of the resonant frequency of the circuit. An amplifier 40 provides desired amplification of the detected signal to output nodes 44.

Another conventional technique for coupling an antenna to an amplifier is shown in FIG. 4. A matching network transforms the impedance of the antenna to an optimal impedance for an amplifier noise factor. The resonant circuit 46 is shown simply with two elements, an inductor and a capacitor. A first matching stage 48 couples the resonant circuit 46 to the second matching stage 50, and so on, for each of the stages. The matching stages conventionally comprise coupled resonators, though high pass or low pass elements have been used. The known drawback of such arrangements is that for a large impedance mismatch, the bandwidth is relatively narrow.

The fabrication of low-loss detection coils from superconductors is possible. Copending application "SUPERCONDUCTING CONTROL ELEMENTS FOR RF ANTENNAS" Ser. No. 07/934,921, Filed Aug. 25, 1992, incorporated herein, discloses low-loss detection coils. These coils may be constructed having a very high-Q. As a result, when the resistance is made very low, and the Q increases, the bandwidth decreases. While signals may be very well detected with such an arrangement, it may be necessary to vary the resonant frequency to detect the signal to compensate for variations in transmit frequency.

Application of conventional technology to superconducting or low-loss coils would suggest the matching network approach. However, the well known limitation of this technique of bandwidth reduction leaves the approach lacking. No satisfactory solution has been proposed heretofore.

SUMMARY OF THE INVENTION

A low loss antenna and low loss capacitor are provided in a resonant configuration, and coupled to a high impedance amplifier. In the preferred embodiment, feedback is provided to the resonant circuit, preferably via a variable feedback resistor. In the most preferred embodiment, a superconducting antenna is resonated with a low-loss capacitor, and coupled to a low noise amplifier. For operation at temperatures currently supporting superconductivity approximately 100° K., junction field effect transistors ("JFETs") are preferred for amplification. The low noise amplifier may be JFETs arranged in a cascode pair.

Advantageously, by coupling the resonant circuit to the low noise amplifier, the resonant circuit operates at a lower Q, effectively increasing the bandwidth of the detector.

Accordingly, it is a major object of this invention to permit a low loss antenna to be coupled effectively to a low noise amplifier.

It is yet a further object to provide a circuit which increases the signal bandwidth of a low loss antenna.

Yet another object of the invention is to permit matching of a low loss antenna to the optimum noise match of a low noise amplifier.

It is yet another object of this invention to broaden the bandwidth of a low loss antenna.

BRIEF DESCRIPTION OF THE DRAWINGS

FIG. 2 is a plot of signal intensity or noise factor as a function of frequency.

FIG. 3 is a circuit diagram of a prior art lossy antenna and amplifier.

FIG. 4 is a circuit diagram of a prior art network matching scheme.

FIG. 5 is a circuit diagram of the resonant circuit plus JFET.

FIG. 6 is a circuit diagram of the resonant circuit and amplifier, including feedback.

FIG. 7 is a detailed circuit diagram of the preferred embodiment.

DETAILED DESCRIPTION OF THE INVENTION

Figure 1:
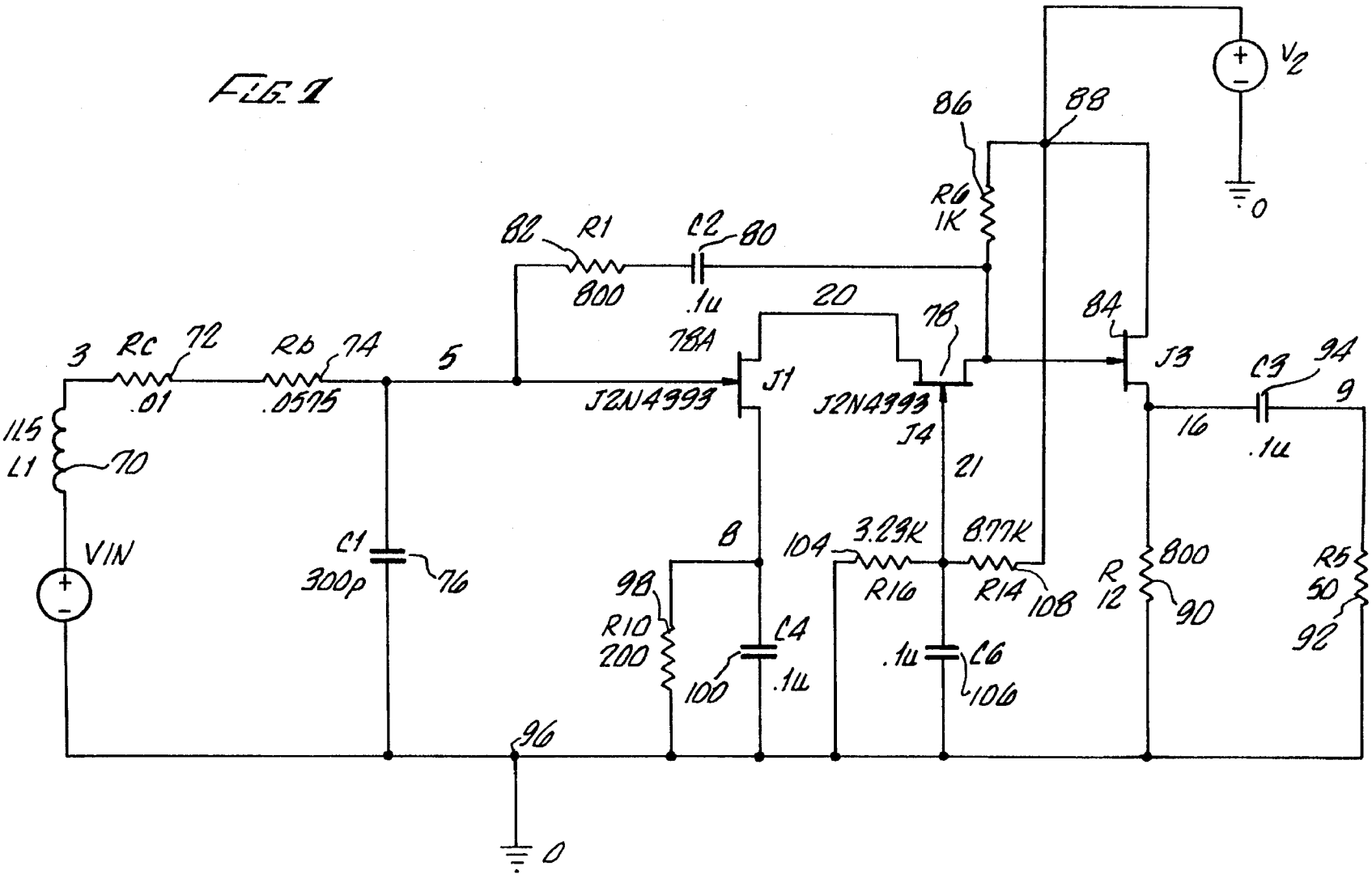
FIG. 1 is a circuit diagram of a resonant circuit.

FIG. 5 shows a simplified circuit diagram of the resonant circuit plus a high impedance amplifier. The antenna is represented by the series combination of inductor 56 ($L_c$) and coil resistor 58 ($R_c$). For completeness, the circuit is shown with a body resistance 60 ($R_b$), which is the resistance incurred because of the presence of a body, or is a radiation resistance in the case of an electrically small antenna (that is, where $\lambda >>$ antenna size). The body resistance $R_b$ is not a discrete component of the circuit, but is an equivalent element in operation. A low loss capacitor 64 is connected across the antenna 56 and 58. A high impedance amplifier 66 is connected with the input signal connected to the gate the output at node 68 may then be amplified further, as desired. The signal exciting the antenna is shown schematically as signal 62.

FIG. 6 shows the circuit of FIG. 5 with the addition of feedback. Generally, feedback is taken from the output of the amplifier 66 and provided back to the input of the amplifier 66. In the preferred embodiment, a variable feedback is provided. Preferably, a variable resistor 68 provides feedback across the amplifier 66. It is desirable to keep the feedback resistor as large as possible consistent with signal bandwidth requirements, to keep amplifier noise low.

As the shunt feedback resistor is increased the input impedance of the amplifier increases, thus reducing the signal bandwidth of the resonate detection circuit. At the same time as the shunt feedback resistor is increased the overall noise factor bandwidth also decreases. It is therefore necessary to find the value of variable feedback resistor which for a given set of conditions gives; lowest overall noise factor, sufficient noise factor bandwidth and sufficient signal gain bandwidth.

FIG. 7 is a detailed circuit diagram of the preferred embodiment. The low loss antenna is represented as series connected inductor 70 and coil resistance 72. The body resistance 74 $R_b$ (or electrically small antenna resistance) is shown in series with the antenna 70 and 72. Again, the body resistance 74 is not a discrete element, but a consideration for proper circuit analysis. Capacitor 76 completes the resonant loop with the antenna 70 and 72. A cascode pair of JFETs 78 receive the output of the resonant circuit as input to one of the cascode pair JFETs 78. The output of the other JFET of the cascode pair provides feedback via capacitor 80 and resistor 82 though shown as a fixed resistor 82, a variable resistor may be used. A third JFET 84 is controlled by the feedback output of the cascode pair 78 via resistor 86. The output signal is taken from node 88 between the resistor 86 and input to the third JFET 84. The output of the third JFET 84 is connected to a reference voltage node 96, preferably ground, via a parallel combination of resistor 90 and the series combination of capacitor 94 and resistor 92. The second output of the cascode pair 78 is connected to the reference node 96 via the parallel combination of resistor 98 and capacitor 100. The gate to the second JFET of the cascode pair is connected to ground via the parallel combination of resistor 108 to the gate of the second JFET of the cascode pair.

All reactive circuit components that are included in the input circuit must have low resistive losses, that is high Q. In FIG. 7 these include: L1, C3 and C4. The feedback resistor is also connected to the input circuit and should add as little noise as possible. The JFET's selected should be low noise and require a high input impedance for optimum noise factor mater. The JFET's should be biased to minimize noise factor. With the drain current likely set near Idss, i.e., Vgs=0. The most important active device is the first stage of gain J1, the noise factor of J2 and J3 matter much less.

By coupling the low loss antenna in a resonant circuit configuration to the high impedance amplifier, a low Q circuit is achieved. As is well known to those in the art, the output signal may be deconvolved with the response curve to provide for correct signals intensity at all frequencies within the bandwidth.

In the preferred embodiment, the low loss antenna is formed from a patterned epitaxial superconductor. Of present day superconductors, YBCO and TlBaCaCuO superconductors are preferred because of their extremely low loss and low surface resistance. Epitaxial films have improved critical current densities and have lower surface resistance, both of which make for improved antenna.

Various advantageous forms of antenna are disclosed in copending application Ser. No. 07/934,921, entitled "SUPERCONDUCTING CONTROL ELEMENTS FOR RF ANTENNAS" filed Aug. 25, 1992, and incorporated herein by reference. Various embodiments are disclosed in that application, any one of which may be used as an antenna with the instant inventions. In one embodiment, a superconducting capacitor is fabricated monolithically on the same substrate as is an inductor. The circuit may be completed by connecting gold contact pads. The capacitance can be easily set by scribing away part of the capacitor and can be easily tuned by placing a dielectric or conductor on top of the capacitor. This embodiment may also include an additional superconducting capacitor as a tuning capacitor which can be used to tune the original capacitor either by scribing the tuning capacitor or by positioning a dielectric or conductor on top of it. Optionally, the signal may be coupled out of the resonant circuit using a superconducting inductor.

Alternatively, a circuit, which includes an interdigital superconducting capacitor fabricated monolithically on the same substrate as an inductor, is completed by conducting cross-overs which are built over the inductor.

Yet another antenna design includes a superconducting inductor attached to two superconducting plates, which is completed by a second superconductor layer which also has two plates that form capacitors with the plates in the first layer and, thus, complete the circuit without using normal metal. The second layer can be added monolithically, by forming superconducting structures on both sides of a dielectric. The second circuit can also be added by hybridizing together two different superconducting structures, separated by a dielectric.

Although the invention has been described with respect to specific preferred embodiments, many variations and modifications may become apparent to those skilled in the art. It is therefore the intention that the appended claims be interpreted as broadly as possible in view of the prior art to include all such variations and modifications.

We claim:

1. A detection circuit for detecting electromagnetic radiation comprising:

a low loss antenna having a characteristic impedance and an output, a semiconductor Field Effect Transistor (FET) amplifier having an input and an output, said output of said low loss antenna being connected directly to said input of said semiconductor amplifier, and an impedance connected to said semiconductor amplifier between said input of said semiconductor FET amplifier and said output of said semiconductor FET amplifier, said impedance and said semiconductor FET amplifier having an optimum noise impedance substantially equal to said characteristic impedance of said low loss antenna.

2. The detection circuit of claim 1 wherein said low loss antenna is a resonant circuit having a high Q.

3. The detection circuit of claim 2 wherein said resonant circuit includes a low loss capacitor.

4. The detection circuit of claim 3 wherein said low loss capacitor includes a superconductor.

5. The detection circuit of claim 3 wherein said low loss capacitor includes a ceramic.

6. The detection circuit of claim 1 wherein said low loss antenna is a coil.

7. The detection circuit of claim 1 wherein said low loss antenna includes a superconductor.

8. The detection circuit of claim 7 wherein said superconductor is chosen from the group: YBCO and TlBaCaCuO superconductors.

9. The detection circuit of claim 1 wherein said semiconductor FET amplifier includes FETs arranged in a cascode pair.

10. The detection circuit of claim 1 wherein said semiconductor FET amplifier is capable of operation at 77° K.

11. The detection circuit of claim 1 wherein said impedance connecting said input of said semiconductor FET amplifier to said output of said semiconductor FET amplifier is a resistor.

12. The detection circuit of claim 11 wherein said resistor is a variable resistor.

13. The detection circuit of claim 1 wherein said low loss antenna is electrically small.

14. The detection circuit of claim 1 wherein electromagnetic radiation capable of being received by said low loss antenna comprises magnetic resonance signals.

* * * * *